US010208964B2

(12) United States Patent
Cupp et al.

(10) Patent No.: US 10,208,964 B2
(45) Date of Patent: Feb. 19, 2019

(54) STEAM COOKING OVEN AND METHOD

(71) Applicants: Timothy L. Cupp, Hillsboro, OH (US); Jeffrey L. Frock, Troy, OH (US); Atul Saksena, Hendersonville, TN (US)

(72) Inventors: Timothy L. Cupp, Hillsboro, OH (US); Jeffrey L. Frock, Troy, OH (US); Atul Saksena, Hendersonville, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 846 days.

(21) Appl. No.: 14/561,497

(22) Filed: Dec. 5, 2014

(65) Prior Publication Data

US 2016/0157657 A1 Jun. 9, 2016

(51) Int. Cl.

| | |
|---|---|
| ***A47J 27/04*** | (2006.01) |
| ***F24C 15/32*** | (2006.01) |
| ***A47J 27/62*** | (2006.01) |

(52) U.S. Cl.

CPC ..... *F24C 15/327* (2013.01)

(58) Field of Classification Search

CPC ..... F24C 15/327; F24C 15/32; A47J 27/04; A47J 27/62

USPC ..... 219/401, 413

See application file for complete search history.

(56) References Cited

U.S. PATENT DOCUMENTS

| | | | |
|---|---|---|---|
| 5,890 | A | 10/1848 | Stevens |
| 76,231 | A | 3/1868 | Morandi |
| 102,608 | A | 5/1870 | Smith |
| 171,411 | A | 12/1875 | Murray |
| 174,194 | A | 2/1876 | Chamberlin |
| 183,554 | A | 10/1876 | Flanders |
| 221,542 | A | 11/1879 | Farrar |
| 225,584 | A | 3/1880 | Flanders |
| 3,000,373 | A | 9/1961 | Hawley |
| 3,604,895 | A | 9/1971 | MacKay |

(Continued)

FOREIGN PATENT DOCUMENTS

| | | | |
|---|---|---|---|
| DE | 2541374 | 3/1977 | |
| DE | 2541374 A1 * | 3/1977 | ..... A23L 5/13 |
| JP | 2856699 | 2/1999 | |

OTHER PUBLICATIONS

PCT, International Search Report and Written Opinion of the International Searching Authority, International Application No. PCT/US2015/061809; dated May 4, 2016, 22 pages.

(Continued)

*Primary Examiner* — Dana Ross
*Assistant Examiner* — Kuangyue Chen
(74) *Attorney, Agent, or Firm* — Thompson Hine LLP

(57) ABSTRACT

A method for reducing energy consumption in a steam cooker that includes a steam cooking cavity, a steam generator for delivering steam along a steam path to the steam cooking cavity, a steam outlet from the steam cooking cavity to a first flow path leading to a drain path. The method involves: (a) utilizing a second flow path from the steam outlet to a vent stack to deliver excess steam flows from the steam cooking cavity up the vent stack rather than down to the drain box; (b) sensing temperature within the vent stack; and (c) utilizing sensed temperature within the vent stack to regulate power of a heating unit of the steam generator to produce steam in a controlled manner that reduces flows of excess steam out of the steam cooking cavity.

12 Claims, 2 Drawing Sheets

(56) References Cited

U.S. PATENT DOCUMENTS

| | | | | |
|---|---|---|---|---|
| 3,744,474 | A | 7/1973 | Shaw | |
| 3,992,984 | A | 11/1976 | Treiber | |
| 4,167,585 | A | 9/1979 | Caridis et al. | |
| 4,273,991 | A | 6/1981 | Bamhill | |
| 4,373,430 | A | 2/1983 | Allen | |
| 4,509,412 | A | 4/1985 | Whittenburg et al. | |
| 4,510,854 | A | 4/1985 | Robertson | |
| 4,528,975 | A | 7/1985 | Wang | |
| 4,582,047 | A | 4/1986 | Williams | |
| 4,649,898 | A | 3/1987 | Martinson | |
| 4,839,502 | A | 6/1989 | Swanson | |
| 5,161,518 | A | 11/1992 | Bedford | |
| 5,287,798 | A | 2/1994 | Takeda | |
| 5,480,597 | A | 1/1996 | Ishida | |
| 5,519,188 | A * | 5/1996 | Yuichi | A01K 41/00 219/398 |
| 5,549,038 | A | 8/1996 | Kolvites | |
| 5,584,235 | A | 12/1996 | DuBois et al. | |
| 5,619,983 | A | 4/1997 | Smith | |
| 5,631,033 | A | 5/1997 | Kolvites | |
| 5,653,161 | A | 8/1997 | Nopanen et al. | |
| 5,662,959 | A | 9/1997 | Tippmann | |
| 5,669,554 | A * | 9/1997 | Nakamura | B01F 3/022 165/222 |
| 5,865,101 | A | 2/1999 | Brown | |
| 5,869,812 | A | 2/1999 | Creamer et al. | |
| 5,968,574 | A | 10/1999 | Sann | |
| 6,000,392 | A | 12/1999 | Stritzl et al. | |
| 6,076,452 | A | 6/2000 | Dessuise | |
| 6,107,605 | A | 8/2000 | Creamer et al. | |
| 6,143,341 | A | 11/2000 | Sikes | |
| 6,175,100 | B1 | 1/2001 | Creamer et al. | |
| 6,453,802 | B1 | 9/2002 | Manganiello | |
| 6,602,530 | B1 | 8/2003 | Weber et al. | |
| 7,669,591 | B2 * | 3/2010 | Fossati | A47J 27/04 126/348 |
| 8,601,939 | B2 | 12/2013 | Saksena | |
| 2006/0081592 | A1 * | 4/2006 | Williams | A21B 3/04 219/401 |
| 2006/0207440 | A1 | 9/2006 | Matsuo et al. | |
| 2006/0251785 | A1 | 11/2006 | Fraccon | |
| 2009/0057592 | A1 | 3/2009 | Lakhan | |

OTHER PUBLICATIONS

PCT, Partial Search Report and Written Opinion, International Application No. PCT/US2015/061809; dated Jan. 22, 2016, 10 pages.

* cited by examiner

STEAM COOKING OVEN AND METHOD

TECHNICAL FIELD

This application relates generally to steam cooking ovens and, more specifically, to a steam cooking oven and associated methods providing energy efficiency.

BACKGROUND

In the commercial cooking environment there are generally two types of steam cooking ovens used. In the typical countertop "atmospheric" steamer the bottom of cooking cavity itself includes a water volume from which steam is produced (i.e., steam is produced directly within the cooking cavity). The cooking cavity has an outlet opening such that excess steam can exit the cavity, where it is delivered up a vent stack. In the typical larger, higher capacity steam oven a separate steam generator is used and a steam feed line runs from the steam generator to the steam cavity. The steam cavity includes a drain outlet opening through which condensed water is delivered to a drain at the site of installation. The steam cavity does not have an associated vent stack, so any excess steam within the cavity is also delivered along the drain path. Generally, this arrangement requires the use of some type of tempering along the drain path so as to assure that the maximum permitted temperature according to applicable code is not exceeded. Delivering steam down the drain wastes energy, due to both the loss of steam and the tempering that must be performed to regulate the drain temperature.

It would be desirable to provide a steam cooking oven of the type including a steam generator external of the cooking cavity, but having improved efficiency.

SUMMARY

In one aspect, a method is provided for meeting Energy Star applicable cooking efficiency requirements in a steam cooker that includes a steam cooking cavity having a door moveable between opened and closed positions for enabling access to the steam cooking cavity, a steam generator defining a volume for holding water and having a water inlet, a steam outlet and an associated heating unit for heating water in the volume so as to generate steam, and a steam path from the steam outlet to the steam cooking cavity. The method involves: (a) utilizing a cavity outlet for excess steam to exit the steam cooking cavity, the cavity outlet fluidly connected via a first flow path to a steam vent stack and via a second flow path to a drain; (b) sensing temperature within the vent stack; (c) utilizing sensed temperature within the vent stack to regulate power of the heating unit to produce steam in a controlled manner that reduces flows of excess steam out of the steam cooking cavity, including: (i) utilizing sensed temperature within the vent stack to identify when little or no excess steam is passing through the vent stack and responsively operating the heating unit at a first power level corresponding to maximum steam production; and (ii) utilizing sensed temperature within the vent stack to identify increasing flow of steam through the vent stack and responsively operating the heating unit at a reduced non-zero power level so as to reduce steam production of the steam generator and thereby reduce steam outflow through the vent stack.

In another aspect, a method is provided for reducing energy consumption in a steam cooker of a type that includes a steam cooking cavity, a steam generator for delivering steam along a steam path to the steam cooking cavity, a steam outlet from the steam cooking cavity to a first flow path leading to a drain box that includes a water tempering arrangement to limit excessively hot flows down a drain associated with the drain box. The method involves: (a) utilizing a second flow path from the steam outlet to a vent stack to deliver excess steam flows from the steam cooking cavity up the vent stack rather than down to the drain box; (b) sensing temperature within the vent stack; and (c) utilizing sensed temperature within the vent stack to regulate power of a heating unit of the steam generator to produce steam in a controlled manner that reduces flows of excess steam out of the steam cooking cavity.

In a further aspect, a steam cooking oven includes a cooking cavity having an access opening for insertion and removal of food product, a door movable between open and closed conditions relative to the access opening, and a steam inlet. A steam generator has a steam outlet connected by a steam feed path to deliver steam to the steam inlet and into the cooking cavity for cooking. The steam generator defines a volume for holding water and includes a heating unit for heating water to generate steam within the steam generator. The cooking cavity includes an outlet located in a lower portion of the cooking cavity. The outlet connects to a drain path for delivering liquid produced by steam condensing in the cooking cavity along the drain path via gravity flow. The outlet also connects to a vent stack such that excess steam exiting the cooking cavity via the outlet progresses upward along the vent stack rather than along the drain path. A temperature sensor is located along the vent stack for sensing temperature within the vent stack. A controller is operatively connected to the heating unit for control thereof and to the temperature sensor. The controller is configured to regulate power of the heating unit according to sensed temperature in the vent stack so as to produce steam in a controlled manner that reduces flows of excess steam out of the steam cooking cavity.

The details of one or more embodiments are set forth in the accompanying drawings and the description below. Other features, objects, and advantages will be apparent from the description and drawings, and from the claims.

DETAILED DESCRIPTION

Figure 1:
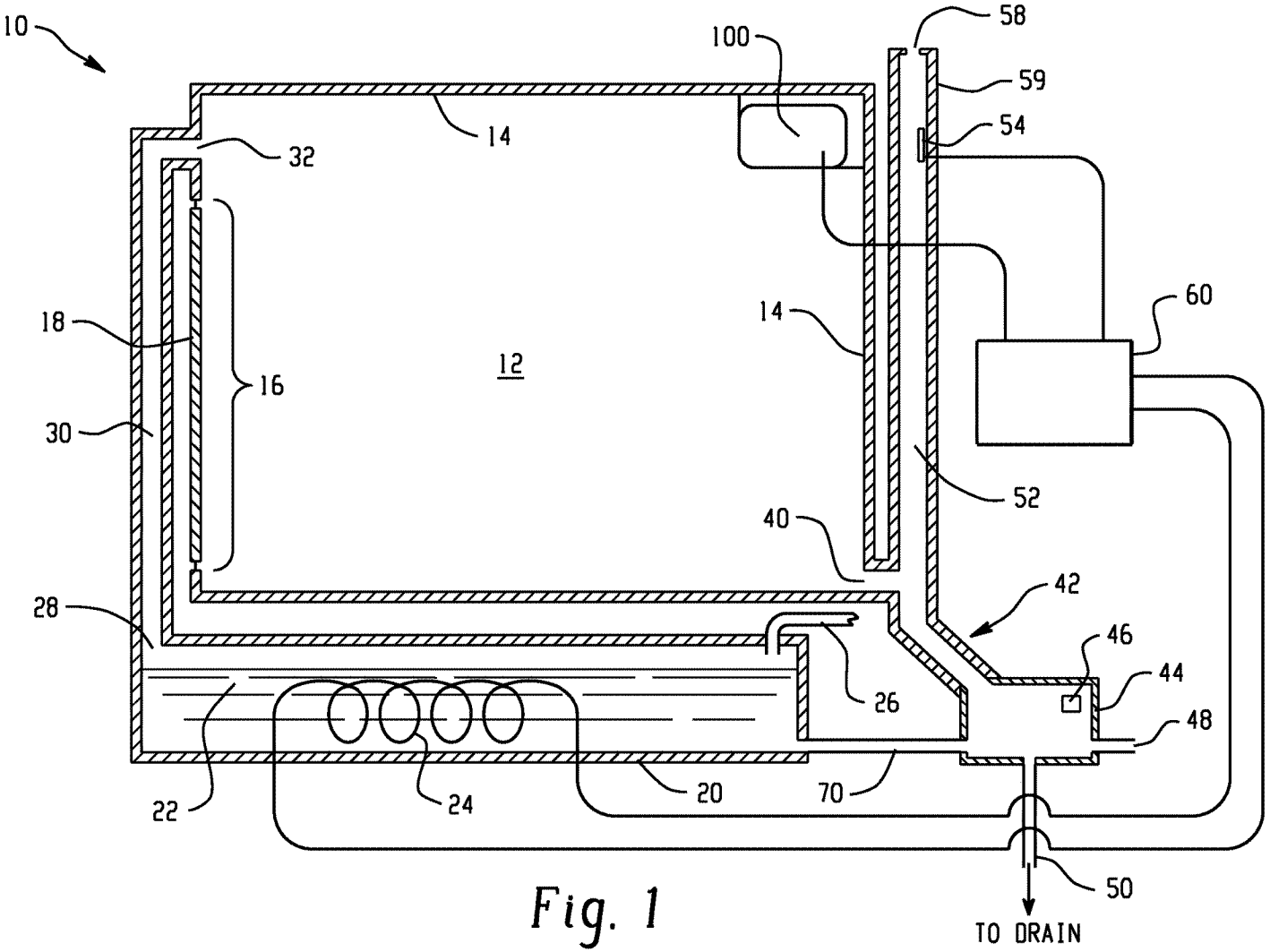
FIG. 1 a schematic depiction of a steam cooking oven.

Referring to FIG. 1, a steam cooking oven 10 is shown schematically includes a cooking cavity 12 for receiving food product. The cooking cavity 12 may be formed by wall structures 14 (e.g., top wall, bottom wall, left side wall, right side wall and rear wall), such as stainless steel with external insulation, all within exterior housing panels. The cavity includes a front access opening 16 through which food product can be passed into and out of the cavity and a door 18 movable (e.g., about a vertically oriented pivot axis) between open and closed conditions relative to the access opening. The cavity 12 may include internal structure for holding food product, such as one or more vertically spaced apart racks, or a turntable.

A steam generator 20 is provided external of the cavity 12 and defines a volume for holding water 22. A heating unit 24 (e.g., shown here in the form of one or more resistive heating elements) is provided for heating water to generate steam within the steam generator. The steam generator includes an inlet 26 for receiving fresh water, which may be filtered by an on-board filter unit, to fill and replenish the volume within the steam generator, typically according to one or more water level sensors that monitor the water level within the steam generator. A steam outlet 28 of the steam generator is connected by a steam feed path 30 (e.g., of suitable piping or tubing) to deliver steam to a steam inlet 32 of the cooking cavity in order to deliver the steam into the cooking cavity for cooking when the oven is turned on for cooking (e.g., such as via a user interface 100).

Generally, food product is placed within the cooking cavity and steam is delivered into the cavity for cooking. As the steam condenses on the food product, latent heat is delivered to the food product for cooking. Some of the water that condenses makes its way to the bottom of the cooking cavity. The cavity therefore includes an outlet 40 located in a lower portion of the cooking cavity. The outlet is connected to a drain path 42 for delivering the liquid produced by steam condensing in the cooking cavity along the drain path via gravity flow. In the illustrated embodiment, the path 42 leads to a drain box 44 that includes a temperature sensor 46 and a cool water input 48 that operate together as a tempering arrangement to assure that the temperature of liquid that exits the box via path 50 to be sent to the building drain does not exceed the maximum permitted temperature according to applicable code.

The outlet 40 is also connected to a vent stack 52 such that excess steam exiting the cooking cavity 12 via the outlet 40 tends to progress upward along the vent stack 52 rather than along the drain path 42. With this configuration, the tempering arrangement in the drain box 44 is not forced to operate to counteract the high temperatures of the steam. At the same time, exhausting a large amount of steam up the vent stack is also undesirable, due both to the potential waste of energy it would produce as well as the desire in commercial cooking facilities to limit the amount of heat and vapors that are delivered into the cooking environment. Accordingly, a temperature sensor 54 is located along the vent stack 52 for sensing temperature within the vent stack. The sensor 54 may, for example, be a probe that extends into the flow path of the vent stack. A controller 60 is operatively connected to the heating unit 24 for control thereof and to the temperature sensor 60. As used herein, the term "controller" is intended to broadly encompass the collection of circuits, processors, software, firmware and/or other components that carry out the various operating and processing functions of the oven and its component parts as described herein. The controller 54 is configured (e.g., programmed or otherwise configured with logic and/or circuits) to control the production of steam in the steam generator 20 in a manner that reduces steam waste and therefore conserves both energy and water.

In particular, the controller 60 may be configured to regulate power of the heating unit 24 according to sensed temperature in the vent stack 52 so as to produce steam in a controlled manner that reduces flows of excess steam out of the steam cooking cavity 12. In order to achieve this result, the controller 60 may operate the heating unit 24 at a power level corresponding to high steam production when a temperature condition, as indicated by sensor 54, within the vent stack 52 is indicative of little or no excess steam passing through the vent stack. The controller 60 operates the heating unit 24 at a reduced power level so as to reduce steam production of the steam generator 20 and thereby reduce steam outflow through the vent stack 52 when a temperature condition within the vent stack 52 is indicative of increasing flow of steam through the vent stack. By way of example, the controller 60 may include PID temperature control function to achieve the desired results, which scales back the power to the heating unit 24 as vapor temperature in the vent stack 52 increases.

In one example, at system start-up the controller 60 keeps the power level of the heating unit 24 at full power level until the temperature in the vent stack reaches 212° F., at which point the controller 60 begins scaling back the power level of the heating unit 24 (e.g., by varying a PWM signal). The controller continues to scale back the power level until the vent stack temperature drops to 211° F., and the power level of the heating unit 24 is thereafter maintained at its then current level until the vent stack temperature drops to 210° F. At the 210° F. threshold, the controller 60 begins to scale the power level back up until the vent stack temperature again reaches 211° F., at which point the then current power level of the heating unit 24 is maintained. Effectively, the controller therefore operates to maintain the vent stack temperature at 211° F., because this temperature is reflective of a condition where the steam cooking cavity is generally full of steam, but where very little steam is exiting the cavity and traveling up the vent stack. This operating methodology involves the use of a wide range of non-zero power levels and reduces water consumption by the steam oven. In addition, because of the marked decrease in generation of excess steam, the amount of cooling water (needed to condense the steam and cool that condensate before it enters the drainage system) is also significantly reduced.

Figure 2:
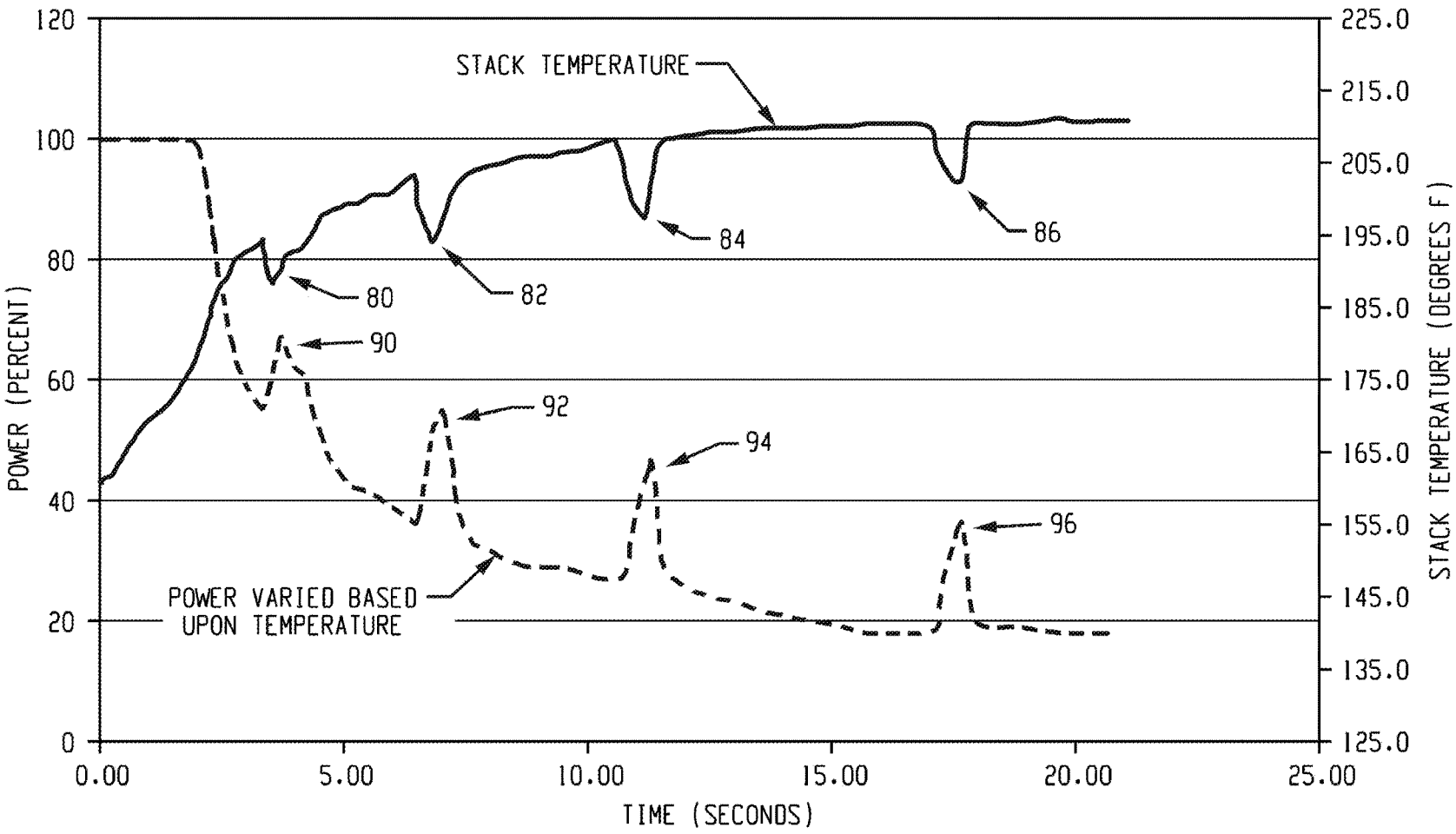
FIG. 2 is a graph showing steam generator heating unit operating power and stack temperature over time.

As another example, and referring now to the graph of FIG. 2, in order to avoid excessive overshoot, the heating unit may initially be operated at full power level (100%), and when the stack temperature (Stack T) reaches about 180° F., the heating power level begins to decrease, and continues to decrease, until the stack temperature approaches 211° F., at which point the operating power level of the heating unit will be substantially lower than the full power level (e.g., less than 30% of full power, or even less than 20% of full power). As shown in regions 8-, 82, 84 and 86 of the graph, rapid temperature decreases at the stack may be experienced, which is caused by the periodic replenishment of water to the steam generator 20, which replenishment momentarily reduces the stack temperature. As demonstrated by regions 90, 92, 94 and 96 of the graph, the controller 100 is configured to responsively compensate by increasing the operating power level of the heating unit 24. The graph of FIG. 2 demonstrates a system in which the controller 100 utilizes stack temperature to vary the operating power level of the steam generator heating unit through a broad range of numerous non-zero power levels (e.g., from 100% down to 20% or even lower).

As shown, the vent stack 52 may include a restricted upward facing outlet opening 58 so as to reduce likelihood of external material entering and flowing back down the vent stack 52. Alternatively, a similar benefit could be achieved by placing the vent stack outlet in side wall of the vent stack (e.g., at location 59). As also shown, the steam generator may be connected via a drain path 70 to the drain box 44 to enable periodic or other selective draining (e.g., at shutdown) of the steam generator (e.g., under control of a valve).

The steam oven as described above therefore provides beneficial methods of steam cooking. In particular, a method of meeting Energy Star applicable cooking efficiency requirements (i.e., as defined by an applicable ENERGY STAR® Program Requirements Product Specification, see www.energystar.gov) in a steam cooking oven is provided.

The method involves: (a) utilizing a cavity outlet for excess steam to exit the steam cooking cavity, the cavity outlet fluidly connected via a first flow path to a steam vent stack and via a second flow path to a drain; (b) sensing temperature within the vent stack; (c) utilizing sensed temperature within the vent stack to regulate power of the heating unit to produce steam in a controlled manner that reduces flows of excess steam out of the steam cooking cavity, including: (i) utilizing sensed temperature within the vent stack to identify when little or no excess steam is passing through the vent stack and responsively operating the heating unit at a first power level corresponding to maximum steam production; and (ii) utilizing sensed temperature within the vent stack to identify increasing flow of steam through the vent stack and responsively operating the heating unit at a reduced non-zero power level so as to reduce steam production of the steam generator and thereby reduce steam outflow through the vent stack. Step (c)(i) may include operating the heating unit at the first power level so long as sensed temperature is below a set threshold, and step (c)(ii) may include scaling back the operating power level of the heating unit once sensed temperature exceeds the set threshold, including progressively reducing the operating power level of the heating unit as sensed temperature progressively increases above the set threshold.

As indicated above, a PID control may be used to control the heating unit based upon sensed temperature. In addition, the first flow path and the second flow path may at least partially overlap as shown. The second flow path may pass through a drain box, and in such cases the method may further include: (d) sensing temperature within the drain box; (e) upon detection of an excess temperature condition within the drain box, responsively delivering cooling fluid into the drain box.

Similarly, a method is provided for reducing energy consumption in a steam cooker of a type that includes a steam cooking cavity, a steam generator for delivering steam along a steam path to the steam cooking cavity, a steam outlet from the steam cooking cavity to a first flow path leading to a drain box that includes a water tempering arrangement to limit excessively hot flows down a drain associated with the drain box. The method involves: (a) utilizing a second flow path from the steam outlet to a vent stack to deliver excess steam flows from the steam cooking cavity up the vent stack rather than down to the drain box; (b) sensing temperature within the vent stack; and (c) utilizing sensed temperature within the vent stack to regulate power of a heating unit of the steam generator to produce steam in a controlled manner that reduces flows of excess steam out of the steam cooking cavity. In one implementation, step (c) may include: utilizing sensed temperature within the vent stack to identify temperature conditions indicative of little or no excess steam passing through the vent stack and responsively operating the heating unit at a power level corresponding to high steam production, and utilizing sensed temperature within the vent stack to identify temperature conditions indicative of increasing flow of steam through the vent stack and responsively operating the heating unit at a reduced power level so as to reduce steam production of the steam generator and thereby reduce steam outflow through the vent stack. Alternatively, or in addition to implementation of the foregoing sentence, step (c) may include reducing power level of the heating unit once sensed temperature meets or exceeds an upper set threshold, increasing power level of the heating unit once sensed temperature drops back down to a lower set threshold that is less than the upper set threshold and/or holding power level of the heating unit steady once sensed temperature falls or rises to an intermediate set threshold that is between the upper set threshold and the lower set threshold.

It is to be clearly understood that the above description is intended by way of illustration and example only, is not intended to be taken by way of limitation, and that other changes and modifications are possible. For example, while submerged resistive heating elements are shown, other types of heating units could be used, including gas-powered units. The cavity size can vary widely. While the steam generator is shown feeding a single steam cooking cavity, it is recognized that a single steam generator could feed more than one cooking cavity, in which case the steam generator could, by way of example, be controlled in response to two different vent stack temperatures, with independently controlled valves used to control steam feed to the different cavities. Alternatively, the vent stacks of the two cavities could be combined, and the cavities effectively fed steam at the same rate.

What is claimed is:

1. A method of meeting Energy Star applicable cooking efficiency requirements in a steam cooker that includes a steam cooking cavity having a door moveable between opened and closed positions for enabling access to the steam cooking cavity, a steam generator external of the steam cooking cavity and defining a volume for holding water and having a water inlet, a steam outlet and an associated heating unit for heating water in the volume so as to generate steam, and a steam path fluidly connecting the steam outlet to the steam cooking cavity, the method comprising:

(a) utilizing a cavity outlet for excess steam to exit the steam cooking cavity, the cavity outlet fluidly connected via a first flow path to a steam vent stack and via a second flow path to a drain;

(b) sensing temperature within the vent stack;

(c) utilizing sensed temperature within the vent stack to regulate power level of the heating unit to produce steam within the steam generator in a controlled manner that reduces flows of excess steam into the steam cooking cavity via the steam path and subsequently out of the steam cooking cavity via the vent stack, including:

(i) utilizing sensed temperature within the vent stack to identify when little or no excess steam is passing through the vent stack and responsively operating the heating unit at its full power level resulting in a maximum steam production rate; and (ii) utilizing sensed temperature within the vent stack to identify increasing flow of steam through the vent stack and responsively operating the heating unit at a reduced non-zero power level, which is less than the full power level, so as to reduce steam production within the steam generator to a reduced rate that is less than the maximum steam production rate and thereby reduce steam flow into the steam cooking cavity and subsequent steam outflow through the vent stack.

2. The method of claim 1 wherein:

step (c)(i) includes operating the heating unit at the full power level so long as sensed temperature is below a set threshold;

step (c)(ii) includes scaling back the operating power level of the heating unit once sensed temperature meets or exceeds the set threshold, including progressively reducing the operating power level of the heating unit as long as sensed temperature meets or exceeds the set threshold.

3. The method of claim 1, wherein the second flow path passes through a drain box, the method further including:

(d) sensing temperature within the drain box;

(e) upon detection of an excess temperature condition within the drain box, responsively delivering cooling fluid into the drain box.

4. The method of claim 1 wherein the first flow path and the second flow path at least partially overlap.

5. The method of claim 1 wherein the vent stack includes one of a restricted upward facing outlet opening or a lateral opening so as to reduce likelihood of external material entering and flowing back down the vent stack.

6. A method of reducing energy consumption in a steam cooker of a type that includes a steam cooking cavity with a steam cavity inlet and a steam cavity outlet, a steam generator for delivering steam along a steam path from an outlet of the steam generator to and into the steam cooking cavity through the steam cavity inlet, the steam cavity outlet connected for delivering steam from the steam cooking cavity to a first flow path that connects the steam cooking cavity to a drain, the method comprising:

(a) utilizing a second flow path from the steam cavity to a vent stack to deliver steam from the steam cooking cavity up the vent stack, rather than down to the drain, when steam flow from the steam generator into the steam cooking cavity is excessive;

(b) sensing temperature within the vent stack;

(c) utilizing sensed temperature within the vent stack to regulate power level of a heating unit of the steam generator to produce steam in the steam generator in a controlled manner that reduces flows of steam into and subsequently out of the steam cooking cavity.

7. The method of claim 6, wherein step (c) includes:

(c)(i) utilizing sensed temperature within the vent stack to identify temperature conditions indicative of little or no excess steam passing through the vent stack and responsively operating the heating unit at its full power level resulting in a maximum steam production rate;

(c)(ii) utilizing sensed temperature within the vent stack to identify temperature conditions indicative of increasing flow of steam through the vent stack and responsively operating the heating unit at a reduced power level, which is less than the full power level, so as to reduce steam production within the steam generator to a reduced rate that is less than the maximum steam production rate and thereby reduce flow of steam into the steam cavity and subsequent outflow of steam through the vent stack.

8. The method of claim 7 wherein:

step (c)(i) includes operating the heating unit at the full power level so long as sensed temperature is below a set threshold;

step (c)(ii) includes scaling back the operating power level of the heating unit once sensed temperature exceeds the set threshold, including progressively reducing the operating power level of the heating unit as long as sensed temperature meets or exceeds the set threshold.

9. The method of claim 6 wherein step (c) includes:

(c)(i) reducing power level of the heating unit once sensed temperature meets or exceeds an upper set threshold;

(c)(ii) increasing power level of the heating unit once sensed temperature drops back down to a lower set threshold that is less than the upper set threshold.

10. The method of claim 9 wherein step (c) includes:

(c)(iii) holding power level of the heating unit steady once sensed temperature falls or rises to an intermediate set threshold that is between the upper set threshold and the lower set threshold.

11. The method of claim 6 wherein the vent stack includes one of a restricted upward facing outlet opening or a lateral opening so as to reduce likelihood of external material entering and flowing back down the vent stack.

12. A method of reducing energy consumption in a steam cooker, comprising:

(a) utilizing a steam cooker that comprises a steam cooking cavity with a steam cavity inlet, a steam generator external of the steam cooking cavity for heating water to produce steam, the steam generator fluidly connected to deliver steam from an outlet of the steam generator to and into the steam cooking cavity through the steam cavity inlet, the steam cooking cavity connected by a first flow path to a drain, and the steam cooking cavity connected by a second flow path to a vent stack;

(b) utilizing the second flow path to deliver steam from the steam cooking cavity and up the vent stack, rather than down to the drain, when steam flow into the steam cooking cavity is excessive;

(c) sensing temperature within the vent stack;

(d) utilizing sensed temperature within the vent stack to regulate power level of a heating unit of the steam generator to produce steam in the steam generator in a controlled manner that reduces flows of steam into and subsequently out of the steam cooking cavity, including:

(d)(i) when sensed temperature within the vent stack indicates that little or no steam is passing through the vent stack, responsively operating the heating unit at a first non-zero power level resulting in steam production at a first rate; and (d)(ii) when sensed temperature within the vent stack indicates an excess level of steam is passing through the vent stack, responsively operating the heating unit at a second non-zero power level, which is less than the first non-zero power level, so as to reduce steam production within the steam generator to a second rate, which is less than the first rate, and thereby reduce flow of steam into the steam cavity and subsequent outflow of steam through the vent stack.

* * * * *